US009162248B2

(12) United States Patent
Piedmont

(10) Patent No.: US 9,162,248 B2
(45) Date of Patent: Oct. 20, 2015

(54) BACKPRESSURE INJECTION FOOT

(75) Inventor: Gregory Henry Piedmont, Helendale, CA (US)

(73) Assignee: LOCKHEED MARTIN CORPORATION, Bethesda, MD (US)

( * ) Notice: Subject to any disclaimer, the term of this patent is extended or adjusted under 35 U.S.C. 154(b) by 483 days.

(21) Appl. No.: 13/323,742

(22) Filed: Dec. 12, 2011

(65) Prior Publication Data

US 2013/0149443 A1 Jun. 13, 2013

(51) Int. Cl.

| | |
|---|---|
| ***B05B 13/06*** | (2006.01) |
| ***B05C 17/005*** | (2006.01) |
| ***B05C 5/02*** | (2006.01) |
| ***B05C 11/10*** | (2006.01) |

(52) U.S. Cl.

CPC ..... *B05C 11/1013* (2013.01); *B05B 13/06* (2013.01); *B05C 5/02* (2013.01); *B05C 17/00503* (2013.01)

(58) Field of Classification Search

None

See application file for complete search history.

(56) References Cited

U.S. PATENT DOCUMENTS

| | | | | | |
|---|---|---|---|---|---|
| 4,489,499 | A * | 12/1984 | Frissora | 33/644 |
| 4,509,884 | A * | 4/1985 | Trout et al. | 405/269 |
| 4,622,085 | A * | 11/1986 | Yamada et al. | 156/94 |
| 5,063,006 | A * | 11/1991 | Tahara | 264/35 |
| 5,277,511 | A * | 1/1994 | Stockton | 401/261 |
| 5,865,555 | A * | 2/1999 | Dawson | 401/266 |
| 6,461,136 | B1 * | 10/2002 | Gruber et al. | 118/301 |
| 6,786,724 | B1 * | 9/2004 | Kwong | 222/575 |

* cited by examiner

*Primary Examiner* — Dah-Wei D Yuan
*Assistant Examiner* — Binu Thomas
(74) *Attorney, Agent, or Firm* — McDermott Will & Emery LLP

(57) ABSTRACT

A backpressure injection foot is provided. The backpressure injection foot includes an injection nozzle for applying an adhesive flowing therethrough onto a planar object having a core structure; and a backpressure foot attached to a distal end of the injection nozzle, wherein the backpressure foot is configured to cover a portion of a plurality of cores disposed within the planar object to facilitate application of the adhesive from a proximal surface of the planar object through to a distal surface of the planar object.

7 Claims, 4 Drawing Sheets

BACKPRESSURE INJECTION FOOT

STATEMENT AS TO RIGHTS TO INVENTIONS MADE UNDER FEDERALLY SPONSORED RESEARCH OR DEVELOPMENT

Not Applicable.

FIELD

The present invention generally relates to an injection foot and, in particular, relates to a backpressure injection foot.

BACKGROUND

Conventional methods for applying adhesive into a continuous planar object having a core structure may rely on hand application of the adhesive with a flexible spatula, by continually pressing the adhesive into the plurality of cores of the planar object. Applying the adhesive by hand limits the volume and rate of adhesive application.

Another method for applying adhesive into the planar object may rely on an adhesive application machine configured to utilize injection methods for apply the adhesive into the plurality of cores. However, adhesive application machines may not reliably apply the adhesive through the plurality of cores because the flow direction of the adhesive may change due to backpressure created by the continuous injection of the adhesive into the cores. Accordingly, a consistent application of the adhesive into the cores of the planar object may not be achieved.

SUMMARY

The following presents a simplified summary of one or more embodiments in order to provide a basic understanding of such embodiments. This summary is not an extensive overview of all contemplated embodiments, and is intended to neither identify key or critical elements of all embodiments nor delineate the scope of any or all embodiments. Its sole purpose is to present some concepts of one or more embodiments in a simplified form as a prelude to the more detailed description that is presented later.

According to various aspects of the subject technology, an apparatus and method is provided for controlling the injection of adhesive into a plurality of cores of a planar object so that a consistent application of the adhesive into the plurality of cores may be achieved. In one aspect, by controlling a backpressure of the adhesive, a flow direction in substantially one direction may be achieved, thereby permitting a consistent application of the adhesive into the plurality of cores.

In accordance with one aspect of the subject technology, a backpressure injection foot is provided. The backpressure injection foot comprises an injection nozzle for applying an adhesive flowing therethrough onto a planar object having a core structure; and a backpressure foot attached to a distal end of the injection nozzle, wherein the backpressure foot is configured to cover a portion of a plurality of cores disposed within the planar object to facilitate application of the adhesive from a proximal surface of the planar object through to a distal surface of the planar object.

According to another aspect of the subject technology, a method for consistently applying an adhesive into a plurality of cores of a planar object is provided. The method comprises applying the adhesive to a first location with an injection nozzle having a backpressure foot, wherein the backpressure foot is configured to cover a portion of the plurality of cores.

The method further comprises monitoring a flow of the adhesive with a flow indicator port on the backpressure foot, wherein the flow indicator port is configured to allow a small amount of the adhesive to flow therethrough. The method further comprises moving the injection nozzle to a second location after the small amount of the adhesive flows through the flow indicator port. The method further comprises aligning the injection nozzle with respect to the first location by using location guide marks disposed on a top surface of the backpressure foot. The method further comprises consistently applying the adhesive into the plurality of cores located at the first and second locations.

Additional features and advantages of the subject technology will be set forth in the description below, and in part will be apparent from the description, or may be learned by practice of the subject technology. The advantages of the subject technology will be realized and attained by the structure particularly pointed out in the written description and claims hereof as well as the appended drawings.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide further understanding of the subject technology and are incorporated in and constitute a part of this specification, illustrate aspects of the subject technology and together with the description serve to explain the principles of the subject technology.

DETAILED DESCRIPTION

In the following detailed description, numerous specific details are set forth to provide a full understanding of the subject technology. It will be apparent, however, to one ordinarily skilled in the art that the subject technology may be practiced without some of these specific details. In other instances, well-known structures and techniques have not been shown in detail so as not to obscure the subject technology. Like components are labeled with identical element numbers for ease of understanding.

Various aspects of the subject technology provides an apparatus and method for controlling the injection of adhesive into a plurality of cores of a planar object so that a consistent application of the adhesive into the plurality of cores may be achieved. In one aspect, by controlling a backpressure of the adhesive, a flow direction in substantially one direction may be achieved, thereby permitting a consistent application of the adhesive into the plurality of cores. The adhesive can include syntactic and low density pastes such as Hysol 9396.6 or high temperature fillet pastes such as Hysol 9395, and may further be thickened to a viscosity between 30 to 3000 Poise. The planar object may be a honeycomb composite panel such as a Hexcel aramid core, aluminum honeycomb, or thermoplastic honeycomb and have varying thicknesses ranging from ½ inch to 2 feet.

Figure 1:
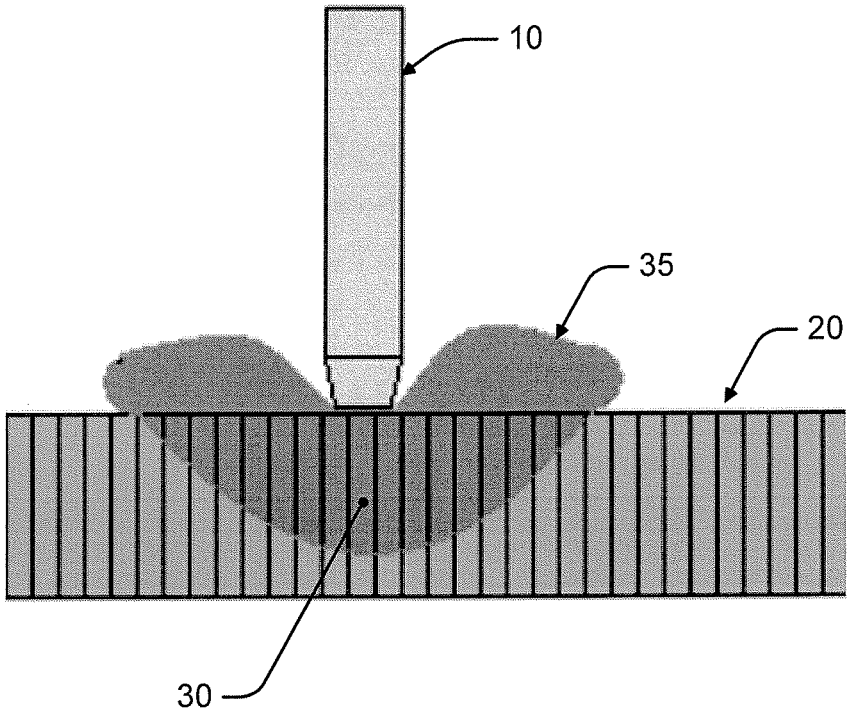
FIG. 1 [Prior Art]
FIG. 1 illustrates injection of an adhesive into a planar object having a core structure by a conventional adhesive application machine.

Referring to FIG. 1, a conventional method for applying an adhesive 30 into a planar object having a core structure 20 may involve an injection nozzle 10 disposed adjacent to the planar object 20. The adhesive 30 is injected into the core structure of the planar object 20. As the adhesive 30 is applied and partially fills the core structure, a backpressure begins to form thereby causing any additional adhesive 35 to flow away from the core structure. Consistent application of the adhesive through the entire core structure is therefore not achieved.

Figure 2:
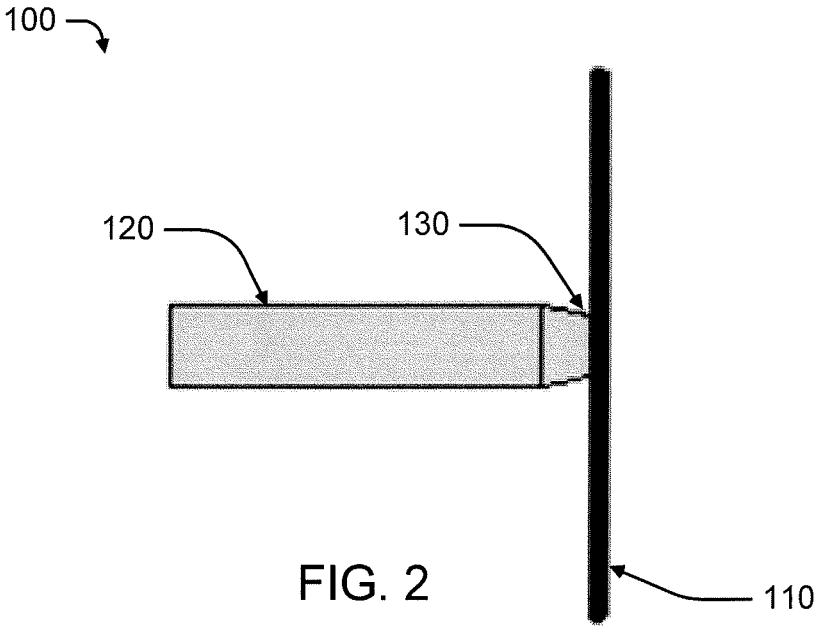
FIG. 2 is a side view of a backpressure injection foot, in accordance with various aspects of the subject technology.

FIG. 2 is a side view of a backpressure injection foot 100, in accordance with various aspects of the subject technology. In some aspects, the backpressure injection foot 100 may comprise an injection nozzle 120 configured to have an adhesive flowing therethrough and a backpressure foot 110 attached to a distal end 130 of the injection nozzle 120.

In some aspects, the injection nozzle 120 is configured to apply the adhesive onto a planar object having a core structure. For example, the injection nozzle 120 may comprise a tubular structure with a tapered distal end 130. The injection nozzle 120 may be manufactured from a material comprising a polymer or metal alloy which may, for example, include brass, copper, aluminum or steel.

In one aspect, the backpressure foot 110 may be configured to be removably attached to the distal end 130 of the injection nozzle 120 to facilitate application and usage of different adhesives onto different thicknesses of planar objects. For example, the backpressure foot 110 may have a threaded connection configured to engage a corresponding threaded connection on the distal end 130 of the injection nozzle 120. In another example, the detachable connection may comprise a magnetic, press-fit, or snap-fit engagement. In another aspect, the backpressure foot may include an adhesive application hole 160 that is aligned with an opening at the distal end 130 of the injection nozzle 120 for allowing the adhesive to flow through the backpressure foot 110.

Figure 3:
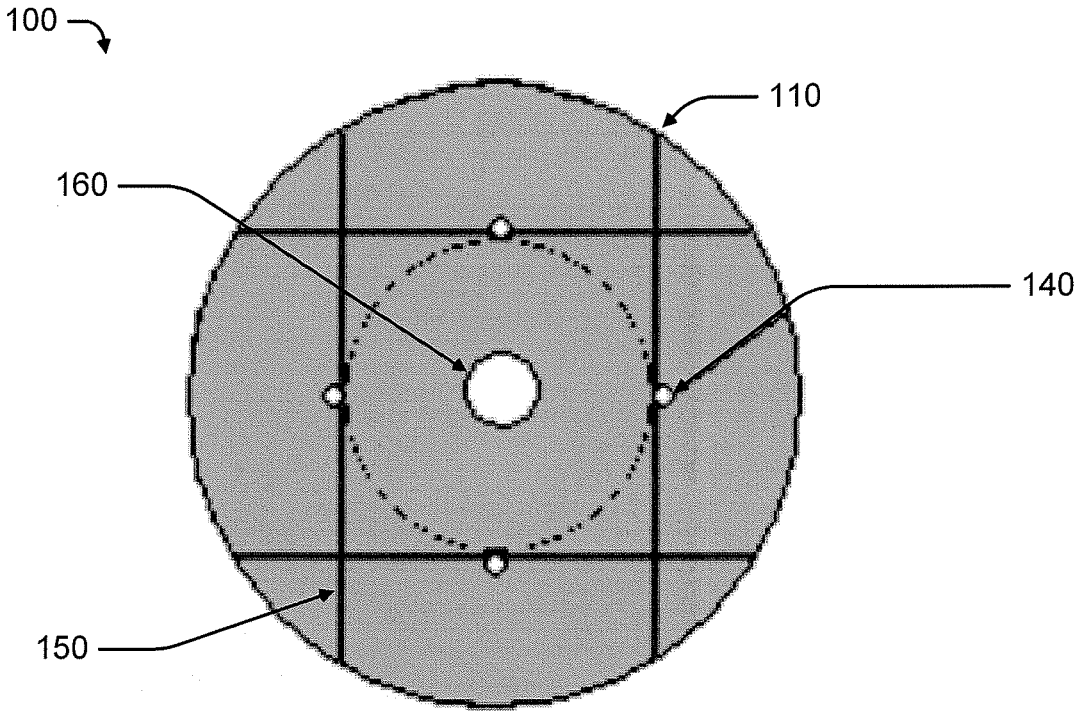
FIG. 3 is a top view of a backpressure foot, in accordance with various aspects of the subject technology.

FIG. 3 is a top view of the backpressure foot 110, in accordance with various aspects of the subject technology. In some aspects, the backpressure foot 110 is configured to cover a portion of a plurality of cores disposed within the planar object. In another aspect, the backpressure foot 110 may prevent a flow direction of the adhesive that is away from the intended flow direction through the plurality of cores. In other words, the backpressure foot 110 may serve as a backstop, thereby promoting the adhesive to flow toward and through the plurality of cores in the intended direction.

In another aspect, the backpressure foot 110 may control a backpressure of the adhesive by preventing the adhesive from flowing away from its intended direction, and thereby provide a consistent application of the adhesive into the portion of the plurality of cores that are disposed adjacent to the injection nozzle 120.

In one aspect, the backpressure foot 110 may comprise a circular shaped plate appropriately sized to cover the portion of the plurality of cores adjacent to the injection nozzle 120. In this example, the backpressure foot 110 may have a diameter of approximately 1 inch to 2 feet. Although in this example the backpressure foot 110 has a circular shape, it is understood that the backpressure foot 110 may have a different shape, such as a rectangular, square, octagonal, hexagonal, or other shape that may be known by one having ordinary skill in the art. In another aspect, the backpressure foot 110 may be manufactured from a rigid material comprising a polymer, rubber, wood or metal alloy that is configured to withstand the backpressure of the adhesive and may, for example, comprise brass, steel, aluminum, copper, polypropylene, polyvinyl, phenolics or composites.

In some aspects, the backpressure foot 110 may comprise a flow indicator port 140 configured to allow a small amount of the adhesive to flow therethrough. By allowing the small amount of adhesive to flow through the flow indicator port 140, an operator may monitor the amount and flow rate of the adhesive that is injected into the planar object or the plurality of cores. In one aspect, a diameter of the flow indicator port 140 may be sized to allow only a small amount of adhesive to flow therethrough without affecting the intended flow direction of the adhesive. The diameter of the flow indicator port 140 may, for example, be between ⅛ inch to ¼ inch.

In another aspect, the flow indicator port 140 may aid the operator in assessing whether sufficient adhesive has been applied to the plurality of cores. For example, after the adhesive injected into the portion of the plurality of cores has filled the plurality of cores, a small amount of adhesive will flow through the flow indicator port 140, thereby signaling that the portion is filled with the adhesive.

In one aspect, the backpressure foot 110 may comprise a plurality of flow indicator ports 140. For example, four flow indicator ports 140 may be disposed equidistant from one another and located between the injection nozzle 120 and an outer edge of the backpressure foot 110. Because the four flow indicator ports 140 are disposed equidistance from one another, the four flow indicator ports 140 thereby provide the operator with a more accurate indication of whether the plurality of cores in the portion are filled with the adhesive.

In another aspect, the backpressure foot 110 may comprise location guide marks 150 disposed on a top surface of the backpressure foot 110. The location guide marks 150 may, for example, comprise scribed or engraved lines that are arranged in a parallel and perpendicular configuration with respect to one another. The location guide marks 150 may comprise a first and second line, parallel to one another, and a third and fourth line parallel to one another but perpendicular to the first and second lines. In one aspect, the center of each location guide mark 150 may be located equidistant from a center axis of the injection nozzle 120. The center of each location guide mark 150 may, for example, be disposed 1 inch to 1 foot from the center axis of the injection nozzle 120. In some aspects, the location guide marks 150 may be used to align the backpressure injection foot 100 with respect to previous passes, such that a complete coverage of the adhesive over the planar object may be achieved.

In some aspects, the flow indicator port 140 may be disposed on the location guide marks 150 to indicate whether the plurality of cores located underneath and between the location guide marks 150 are filled with the adhesive. For example, as the adhesive flows into and fills the plurality of cores, the flow indicator ports 140 will allow a small amount of the adhesive to flow therethrough, indicating that the adhesive has filled the plurality of cores located underneath and between the location guide marks 150, thereby aiding the operator in assessing whether the plurality of cores are filled and whether to move the backpressure injection foot 100 to an unfilled portion of the planar object.

Figure 4:
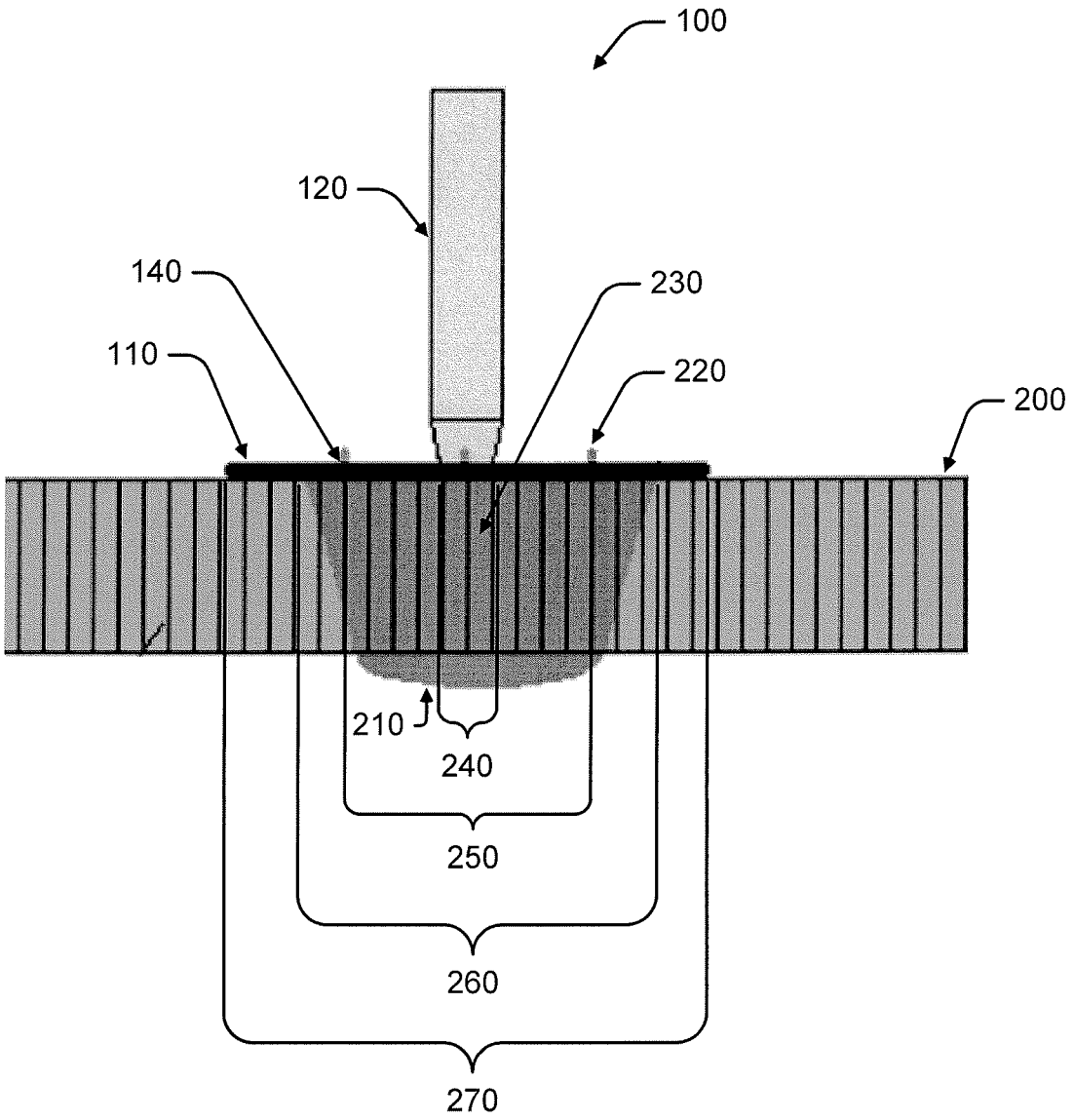
FIG. 4 illustrates operation of a backpressure injection foot, in accordance with various aspects of the subject technology.

FIG. 4 illustrates operation of the backpressure injection foot 100, in accordance with various aspects of the subject technology. First, the backpressure injection foot 100 is located on a proximal surface of the planar object 200, thereby covering a proximal end of the portion of the plurality of cores 270 that are located underneath the backpressure foot 110. In some aspects, the plurality of cores may comprise hexagonal shaped cores having a honeycomb structure. The honeycomb may be manufactured using a number of different production processes including an expansion method or a corrugated process, as known by those of ordinary skill in the art.

The adhesive 230 is then injected into the plurality of cores 270. As the adhesive 230 is injected into the plurality of cores 270, the adhesive first flows into the cores 240 that are located directly underneath the injection nozzle 120.

As the cores 240 become filled with the adhesive, a backpressure may build. The backpressure foot 110 controls the backpressure by preventing the adhesive 230 from flowing away from its intended direction by covering the proximal ends of the plurality of cores 270. The adhesive 230 is therefore forced to flow through the entire length of the cores 240 until the adhesive flows through to a distal end of the cores 210. Continuous injection of the adhesive 230 causes the additional injection to flow outward, through adjacent unfilled cores, and to a distal surface of the planar object 200.

After the adhesive 230 fills the cores 250 that are located under the flow indicator ports 140, a small amount of the adhesive 220 will flow through the flow indicator ports 140, thereby indicating that the cores 250 located underneath and between the flow indicator ports 140 are filled. Once the operator sees the adhesive exiting the flow indicator ports 140, the operator may assess whether sufficient adhesive has been applied, whether sufficient injection pressure has been achieved, and whether to locate the backpressure injection foot 100 elsewhere on the planar object 200 by using, for example, the location guide marks 150 to align the backpressure injection foot 100 with respect to previous passes, such that a complete coverage of adhesive over the entire planar object 200 may be achieved.

After the flow indicator ports 140 allow the small amount of adhesive 220 to flow therethrough, the adhesive 230 will continue to fill adjacent unfilled cores 260 until the backpressure injection foot 100 is either moved or injection of the adhesive is stopped.

Figure 5:
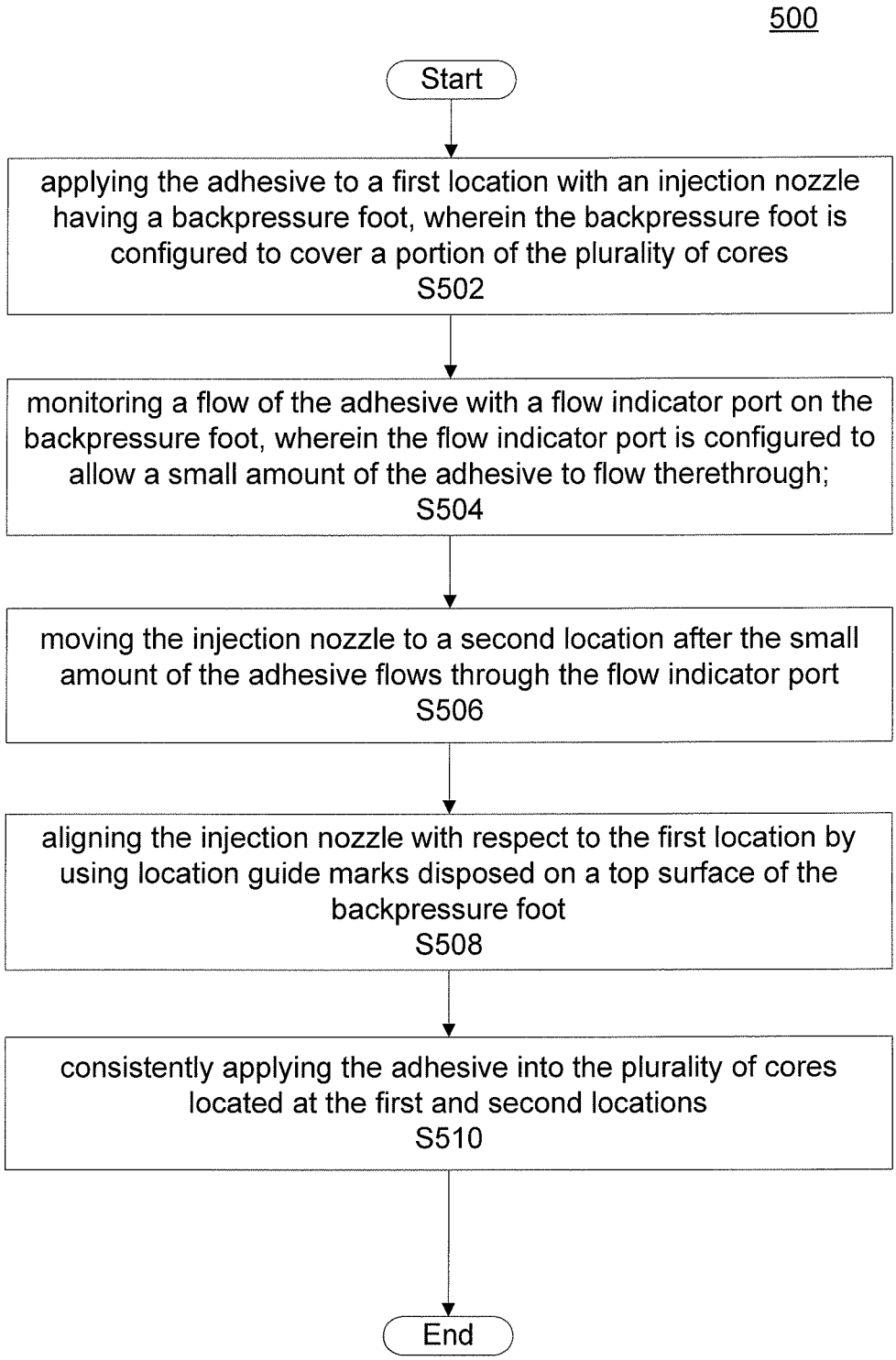
FIG. 5 illustrates an example of a method for consistently applying an adhesive into a plurality of cores of a planar object, in accordance with various aspects of the subject technology.

FIG. 5 illustrates an example of a method 500 for consistently applying an adhesive into a plurality of cores of a planar object, in accordance with various aspects of the subject technology. Method 500 comprises applying the adhesive to a first location with an injection nozzle having a backpressure foot, wherein the backpressure foot is configured to cover a portion of the plurality of cores (S502) and monitoring a flow of the adhesive with a flow indicator port on the backpressure foot, wherein the flow indicator port is configured to allow a small amount of the adhesive to flow therethrough (S504). The method also comprises moving the injection nozzle to a second location after the small amount of the adhesive flows through the flow indicator port (S506) and aligning the injection nozzle with respect to the first location by using location guide marks disposed on a top surface of the backpressure foot (S508). The method further comprises consistently applying the adhesive into the plurality of cores located at the first and second locations (S510).

The foregoing description is provided to enable a person skilled in the art to practice the various configurations described herein. While the subject technology has been particularly described with reference to the various figures and configurations, it should be understood that these are for illustration purposes only and should not be taken as limiting the scope of the subject technology.

There may be many other ways to implement the subject technology. Various functions and elements described herein may be partitioned differently from those shown without departing from the scope of the subject technology. Various modifications to these configurations will be readily apparent to those skilled in the art, and generic principles defined herein may be applied to other configurations. Thus, many changes and modifications may be made to the subject technology, by one having ordinary skill in the art, without departing from the scope of the subject technology.

It is understood that the specific order or hierarchy of steps in the processes disclosed is an illustration of exemplary approaches. Based upon design preferences, it is understood that the specific order or hierarchy of steps in the processes may be rearranged. Some of the steps may be performed simultaneously. The accompanying method claims present elements of the various steps in a sample order, and are not meant to be limited to the specific order or hierarchy presented.

Terms such as "top," "bottom," "front," "rear" and the like as used in this disclosure should be understood as referring to an arbitrary frame of reference, rather than to the ordinary gravitational frame of reference. Thus, a top surface, a bottom surface, a front surface, and a rear surface may extend upwardly, downwardly, diagonally, or horizontally in a gravitational frame of reference.

A phrase such as an "aspect" does not imply that such aspect is essential to the subject technology or that such aspect applies to all configurations of the subject technology. A disclosure relating to an aspect may apply to all configurations, or one or more configurations. A phrase such as an aspect may refer to one or more aspects and vice versa. A phrase such as an "embodiment" does not imply that such embodiment is essential to the subject technology or that such embodiment applies to all configurations of the subject technology. A disclosure relating to an embodiment may apply to all embodiments, or one or more embodiments. A phrase such an embodiment may refer to one or more embodiments and vice versa.

Furthermore, to the extent that the term "include," "have," or the like is used in the description or the claims, such term is intended to be inclusive in a manner similar to the term "comprise" as "comprise" is interpreted when employed as a transitional word in a claim.

The word "exemplary" is used herein to mean "serving as an example, instance, or illustration." Any embodiment described herein as "exemplary" is not necessarily to be construed as preferred or advantageous over other embodiments.

A reference to an element in the singular is not intended to mean "one and only one" unless specifically stated, but rather "one or more." The term "some" refers to one or more. Underlined and/or italicized headings and subheadings are used for convenience only, do not limit the subject technology, and are not referred to in connection with the interpretation of the description of the subject technology. All structural and functional equivalents to the elements of the various configurations described throughout this disclosure that are known or later come to be known to those of ordinary skill in the art are expressly incorporated herein by reference and intended to be encompassed by the subject technology. Moreover, nothing disclosed herein is intended to be dedicated to the public regardless of whether such disclosure is explicitly recited in the above description.

What is claimed is:

1. A backpressure injection foot comprising:

an injection nozzle configured to apply an adhesive flowing therethrough along a center axis of the injection nozzle onto a planar object having a core structure; and a backpressure foot attached to a distal end of the injection nozzle, wherein the backpressure foot is configured to cover a portion of a plurality of cores disposed within the planar object and located beyond an outer diameter of the injection nozzle, the backpressure foot configured to facilitate application of the adhesive into the portion of the plurality of cores located beyond the outer diameter from a proximal surface of the planar object through to a distal surface of the planar object, wherein the backpressure foot comprises a first surface perpendicular to the center axis of the injection nozzle, wherein the back pressure foot comprises location guide marks disposed on the first surface, wherein the first surface comprises an adhesive application hole at a center of the first surface, wherein the adhesive application hole is aligned with an opening at the distal end of the injection nozzle, and wherein a center of each of the location guide marks is located equidistant from a center of the adhesive application hole.

2. The backpressure injection foot of claim 1, wherein the backpressure foot is removably attached to the distal end of the injection nozzle.

3. The backpressure injection foot of claim 1, wherein the backpressure foot comprises a circular rigid plate.

4. The backpressure injection foot of claim 1, wherein the backpressure foot comprises a flow indicator port configured to allow a small amount of the adhesive to flow therethrough.

5. The backpressure injection foot of claim 4, wherein the flow indicator port comprises four indicator ports, disposed equidistant from one another and located between the injection nozzle and an outer edge of the backpressure foot.

6. The backpressure injection foot of claim 1, wherein the location guide marks comprise a first location guide mark comprising a first line and a second line, wherein the first line is perpendicular to the second line.

7. The backpressure injection foot of claim 4, wherein the flow indicator port is disposed on the location guide marks.

* * * * *